US009833069B1

(12) United States Patent
Gutierrez

(10) Patent No.: US 9,833,069 B1
(45) Date of Patent: Dec. 5, 2017

(54) CONCEALED VALUABLE STORAGE BOX

(71) Applicant: Edwardo Gutierrez, Mesa, AZ (US)

(72) Inventor: Edwardo Gutierrez, Mesa, AZ (US)

( * ) Notice: Subject to any disclaimer, the term of this patent is extended or adjusted under 35 U.S.C. 154(b) by 0 days.

(21) Appl. No.: 14/963,645

(22) Filed: Dec. 9, 2015

Related U.S. Application Data

(63) Continuation-in-part of application No. 14/198,747, filed on Mar. 6, 2014, now Pat. No. 9,260,904.

(60) Provisional application No. 61/791,016, filed on Mar. 15, 2013.

(51) Int. Cl.
*A47B 81/00* (2006.01)
*A47B 96/00* (2006.01)

(52) U.S. Cl.
CPC ..... *A47B 81/00* (2013.01); *A47B 96/00* (2013.01)

(58) Field of Classification Search
USPC ..... 174/66, 55
See application file for complete search history.

(56) References Cited

U.S. PATENT DOCUMENTS

| | | | | |
|---|---|---|---|---|
| 3,930,702 | A * | 1/1976 | Pichowicz | A47B 67/02 206/457 |
| 4,264,013 | A * | 4/1981 | Vollmer | A47G 29/08 211/85.2 |
| 4,753,495 | A * | 6/1988 | Swink | A47F 5/02 211/163 |
| 5,141,300 | A * | 8/1992 | Ciesla | A47B 9/00 206/566 |
| 5,534,664 | A * | 7/1996 | Fearing, Jr. | F21V 19/04 174/50 |
| 9,260,904 | B1 * | 2/2016 | Gutierrez | E05G 1/04 |
| 2010/0258332 | A1 * | 10/2010 | Yarborough | H02G 3/14 174/66 |

* cited by examiner

*Primary Examiner* — Dhirubhai R Patel
(74) *Attorney, Agent, or Firm* — Kenneth L Tolar

(57) ABSTRACT

A valuable storage box includes a hollow housing embedded within a wall having a plurality of sidewalls and an open face in communication with an interior storage chamber. A cover plate securable over the open face includes at least one faux electrical component thereon, such as a simulated light switch or electrical receptacle. Accordingly, when valuables are placed within the storage chamber and the cover plate is fastened, the storage box deceptively resembles an operable wall-mounted electrical plate.

2 Claims, 2 Drawing Sheets

CONCEALED VALUABLE STORAGE BOX

CROSS REFERENCE TO RELATED APPLICATIONS

This application is a continuation-in-part of utility application Ser. No. 14/198,747 filed on Mar. 6, 2014, now U.S. Pat. No. 9,260,904, which claimed the benefit of provisional patent application No. 61/791,016 filed on Mar. 15, 2013, the specifications of which are both incorporated herein by reference.

BACKGROUND OF THE INVENTION

The present invention relates to a valuable storage box that deceptively resembles a conventional light-switch plate, electrical receptacle or similar functional wall plate.

DESCRIPTION OF THE PRIOR ART

Because most people store valuables in a jewelry box that is concealed within a drawer or closet, burglars usually search such locations immediately. Once located, the jewelry box is easily emptied of its contents; even if a jewelry box contains a lock, it can be easily transported to another location and dismantled. Though safes and similar, larger vaults are not typically transportable, they are easy to locate and their locking systems can be compromised by sophisticated thieves.

Accordingly, there is currently a need for a device that more securely conceals valuables. The present invention addresses this need by providing a storage box that resembles an operable light switch, electrical receptacle or similar wall plate so as to be completely inconspicuous to a burglar.

SUMMARY OF THE INVENTION

The present invention relates to a valuable storage box including a hollow housing embedded within a wall having a plurality of sidewalls and an open face in communication with an interior storage chamber. A cover plate securable over the open face includes at least one faux electrical component thereon, such as a simulated light switch or electrical receptacle. Accordingly, when valuables are placed within the storage chamber and the cover plate is fastened, the storage box deceptively resembles an operable wall-mounted electrical plate.

It is therefore an object of the present invention to provide a storage box for valuables that is inconspicuously concealed behind a wall.

It is another object of the present invention to provide a storage box for valuables that deceptively resembles an operable light switch.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
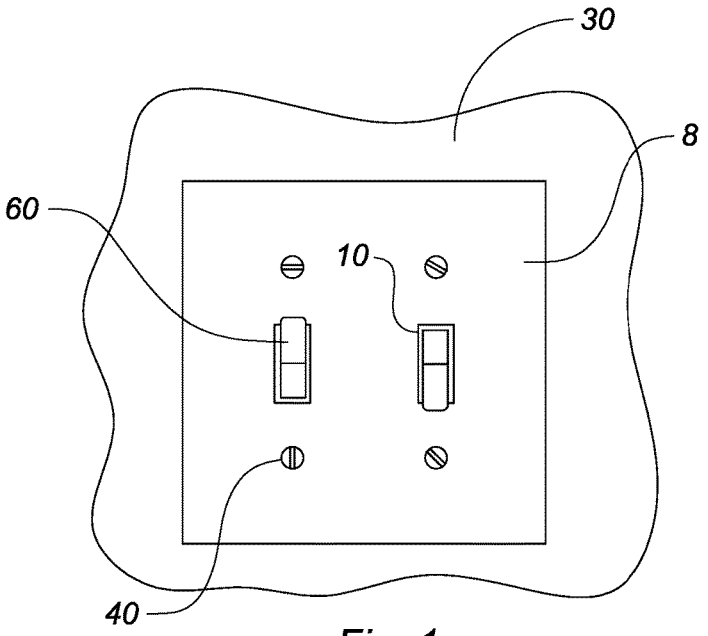
FIG. 1 is a plan view of the storage box according to the present invention installed within a wall, wherein the faceplate resembles an operable light switch.
Figure 2:
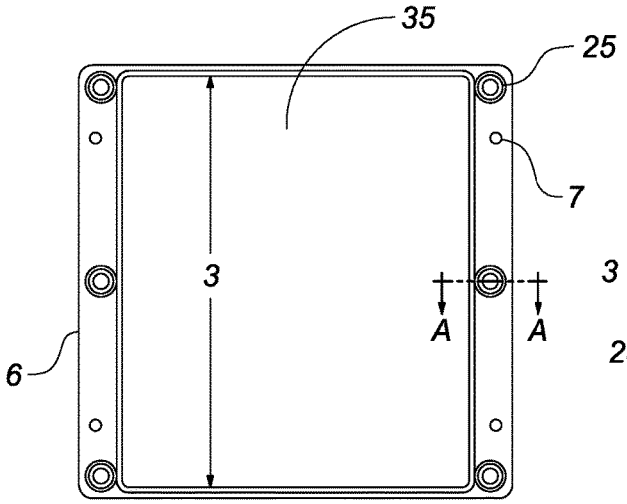
FIG. 2 is a front, plan view of the storage box.
Figure 4:
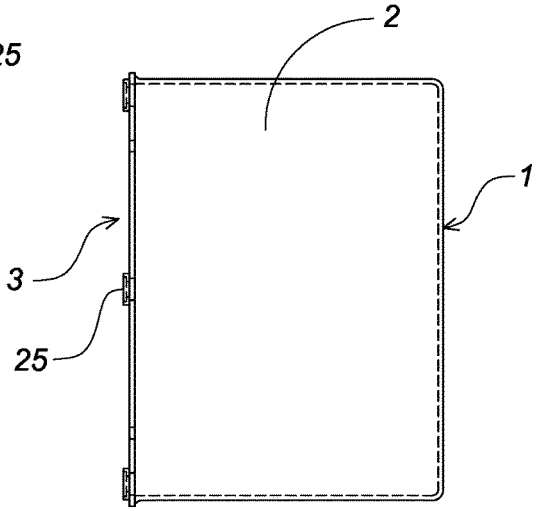
FIG. 4 is a side view of the storage box.
Figure 3:
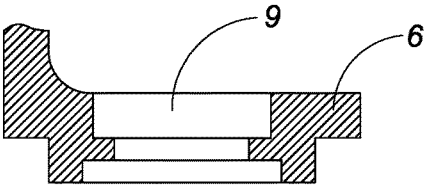
FIG. 3 is a sectional view of the storage box taken along A-A of FIG. 2.

The present invention relates to a valuable storage box comprising a hollow housing 1 having a plurality of sidewalls 2 and an open face 3 in communication with an interior storage chamber 35. Surrounding the open face is a peripheral lip 6 having apertures 7 thereon that receive fasteners to secure the housing to a wall. The peripheral lip further includes a plurality of spaced cavities 9 that each receive a magnet 15 having a predetermined polarity.

The device also includes a cover plate 8 having a front surface, a rear surface, multiple peripheral edges 50 and at least one window 10. Each peripheral edge includes spaced pockets 13 that each receive a magnet 14 having an opposite polarity than the predetermined polarity of the magnets on the housing rim. The pockets are spaced and positioned to align with a designated magnet on the housing when the cover plate is properly superimposed thereon.

Figure 5:
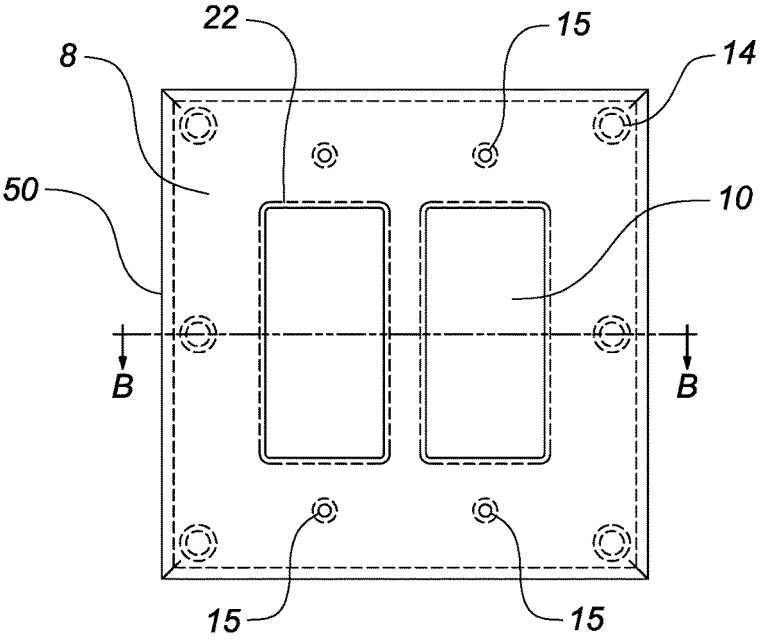
FIG. 5 is a front, plan view of the cover plate.
Figure 6:
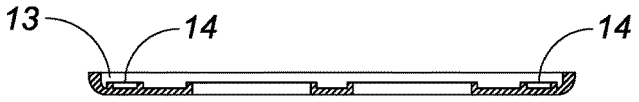
FIG. 6 is a sectional view of the cover plate taken along B-B of FIG. 5.
Figure 7:
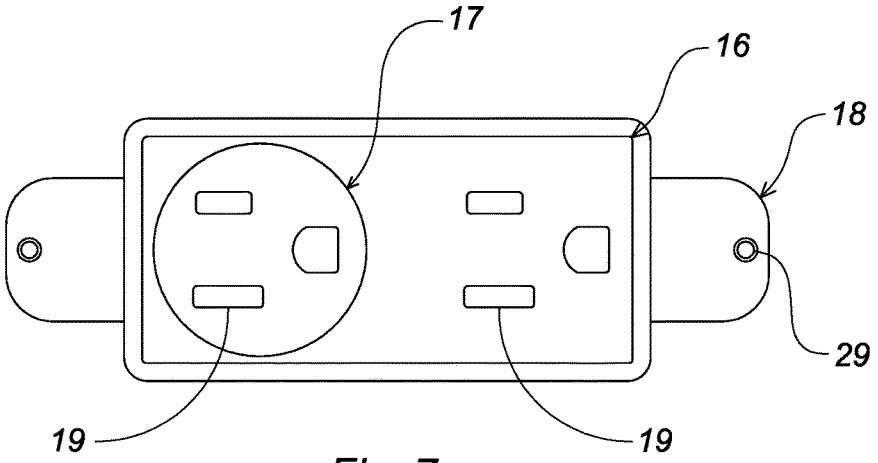
FIG. 7 is a front, plan view of an exemplary insert.

Immediately above and below each window 10 is a bore 15 that receives a threaded fastener 40 to secure an interchangeable insert 16 to the cover plate that resembles a functioning electrical component on a conventional wall plate. For example, now referring to FIG. 7, the insert may resemble a conventional electrical receptacle 19 having a flange 18 extending from both an upper and lower end. Each flange includes an aperture 29 for aligning with the bore 15 on the cover plate when the insert is properly positioned on the rear surface. The faux functioning component of the insert seats within the window of the cover plate. For example, the receptacle may align with a circular window 17 on the cover plate as depicted in FIG. 7. If the insert resembles a rocker or toggle 60 switch, it seats within a rectangular window 22 as depicted in FIG. 5.

To install the storage box, a user first cuts a hole in a desired location on an interior wall 30. The hole is dimensioned so that the peripheral lip on the housing engages the surrounding sheet rock to allow fasteners to be inserted through the apertures 7 and anchored to the wall. Alternatively, the hole may be formed adjacent to a stud so that the housing can be fastened thereto. Valuables are placed within the interior storage chamber and the insert is fastened to the rear surface of the cover plate, which is then superimposed on the open face. The oppositely polarized, aligned magnets cling to firmly secure the cover plate to the housing. To remove the valuables, the user simply pulls the cover plate away from the housing. Accordingly, when the valuables are stored and the cover plate is properly secured, the storage box deceptively resembles an operable light switch, electrical receptacle or other wall-mounted electrical component.

The above-described device is not limited to the exact details of construction and enumeration of parts provided herein. For example, though the cover plate insert depicted in the drawings resembles an electrical receptacle, it can also resemble a 1, 2, 3 or 4-gang light switch. In addition, the insert can also be configured to resemble a blank, a cable or satellite TV jack, a vent, a smoke detector, a thermostat, a clock, a picture, a door bell or any other similar wall-mounted item without departing from the spirit of the present invention. Also, the various components could be pre-treated with a deodorizing material and the cover plate and insert could include a phosphorescent material to glow in the dark. Larger housings could be equipped with removable shelves to organize stored items. Furthermore, the magnetic fasteners could be replaced with hook-and-loop fasteners, snaps or similar mechanisms that easily secure the plate to the housing. Finally, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a wall having a hole formed therein, a concealed valuable storage box comprising:

a hollow housing received within said hole and secured to said wall, said housing having a plurality of sidewalls, an open face in communication with an interior storage chamber and a peripheral edge surrounding said open face;

at least a first magnet on the peripheral edge of said housing, said first magnet having a predetermined polarity;

a cover plate superimposed on said open face, said cover plate having a front surface, a rear surface, a plurality of peripheral edges and a plurality of pockets on at least one of said peripheral edges, said front surface resembling a wall-mounted electrical item, said cover plate having at least a second magnet received within one of said plurality of pockets on one of said peripheral edges, said one of said one of said plurality of pockets is spaced and positioned to align with the first magnet on the housing when the cover plate is properly superimposed thereon, said second magnet having a polarity opposite the predetermined polarity, said second magnet positioned to engage said first magnet when said cover plate is superimposed on said open face to secure said cover plate to said housing to conceal valuables within said interior storage chamber.

2. The combination according to claim 1 further comprising:

at least one window on said cover plate;

an interchangeable insert removably securable to the rear surface of said cover plate, said insert having a faux electrical component thereon that fits within said window when the insert is secured to the cover plate to allow a user to convert an appearance of said cover plate to a different wall-mounted electrical item.

* * * * *